US007413060B2

(12) United States Patent
Takashi et al.

(10) Patent No.: US 7,413,060 B2
(45) Date of Patent: Aug. 19, 2008

(54) CAR FALL-PREVENTION APPARATUS

(75) Inventors: Tanaka Takashi, Chiba-ken (JP); Otoyo Hirohumi, Chiba-ken (JP)

(73) Assignee: Otis Elevator Company, Farmington, CT (US)

( * ) Notice: Subject to any disclaimer, the term of this patent is extended or adjusted under 35 U.S.C. 154(b) by 254 days.

(21) Appl. No.: 10/580,352

(22) PCT Filed: Dec. 10, 2004

(86) PCT No.: PCT/US2004/041309

§ 371 (c)(1),
(2), (4) Date: May 23, 2006

(87) PCT Pub. No.: WO2005/065142

PCT Pub. Date: Jul. 21, 2005

(65) Prior Publication Data

US 2007/0170011 A1 Jul. 26, 2007

(30) Foreign Application Priority Data

Dec. 19, 2003 (JP) ..... 2003-422435

(51) Int. Cl.
*B66B 7/00* (2006.01)

(52) U.S. Cl. ..... 187/414; 187/351; 187/356

(58) Field of Classification Search ..... 187/351, 187/356, 367, 378, 379, 371, 372, 374, 414; 104/252, 257, 127–128; *B66B 5/00, 5/04, B66B 7/00, 7/02*

See application file for complete search history.

(56) References Cited

U.S. PATENT DOCUMENTS

| | | | | |
|---|---|---|---|---|
| 177,290 A | | 5/1876 | Smith | |
| 226,330 A | | 4/1880 | Lee | |
| 255,646 A | | 3/1882 | McCarroll | |
| 282,763 A | | 8/1883 | Parker et al. | |
| 642,448 A | | 1/1900 | Holmes | |
| 1,165,929 A | | 12/1915 | Zaradzki | |
| 2,503,954 A | | 4/1950 | Lindahl | |
| 2,660,959 A | * | 12/1953 | Stickler, Jr. | 104/252 |
| 4,331,219 A | * | 5/1982 | Suzuki | 187/207 |
| 4,333,549 A | * | 6/1982 | Davis | 187/377 |
| 5,601,157 A | | 2/1997 | Barth | |
| 5,727,657 A | | 3/1998 | Foelix | |
| 5,771,995 A | | 6/1998 | Cooney et al. | |
| 5,806,633 A | | 9/1998 | Macuga | |
| 6,138,798 A | | 10/2000 | Macuga | |
| 6,736,242 B2 | | 5/2004 | Nygren | |

FOREIGN PATENT DOCUMENTS

| | | |
|---|---|---|
| EP | 1 052 212 | 11/2000 |
| JP | 10-167611 | 6/1998 |
| JP | 3209931 | 7/2001 |
| JP | 2005-178997 | 7/2005 |
| WO | WO 97/23399 | 7/1997 |

OTHER PUBLICATIONS

International Search Report and Written Opinion of the International Searching Authority for PCT/US04/41309 dated Jun. 5, 2006.

* cited by examiner

*Primary Examiner*—Peter M. Cuomo
*Assistant Examiner*—Stefan Kruer

(57) ABSTRACT

An elevator fall-prevention apparatus includes a holding member, which is shaped approximately like a rectangular tube, secured to a base part of an elevator guide rail. The holding member supports a locking support member that is rotatable about a spindle from a standby position into a blocking position.

4 Claims, 6 Drawing Sheets

FIG.2
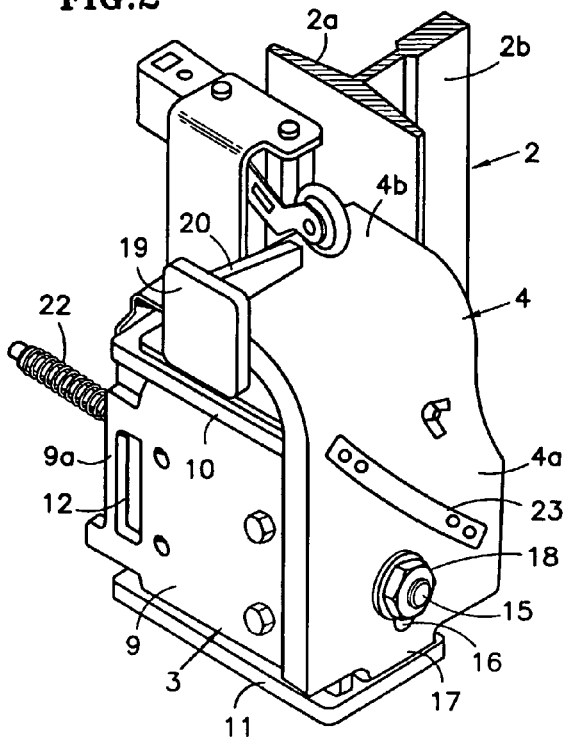
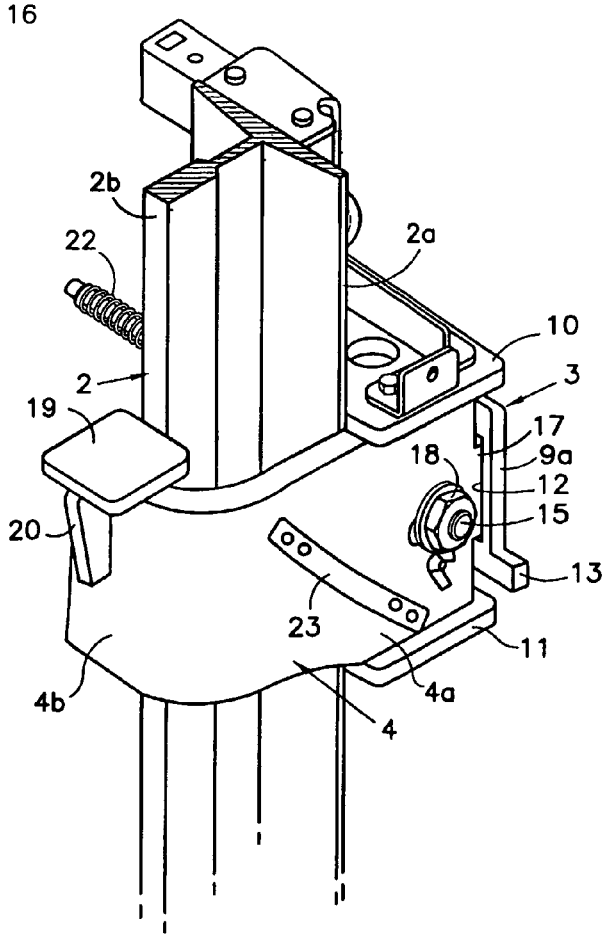
FIG.3

FIG.4
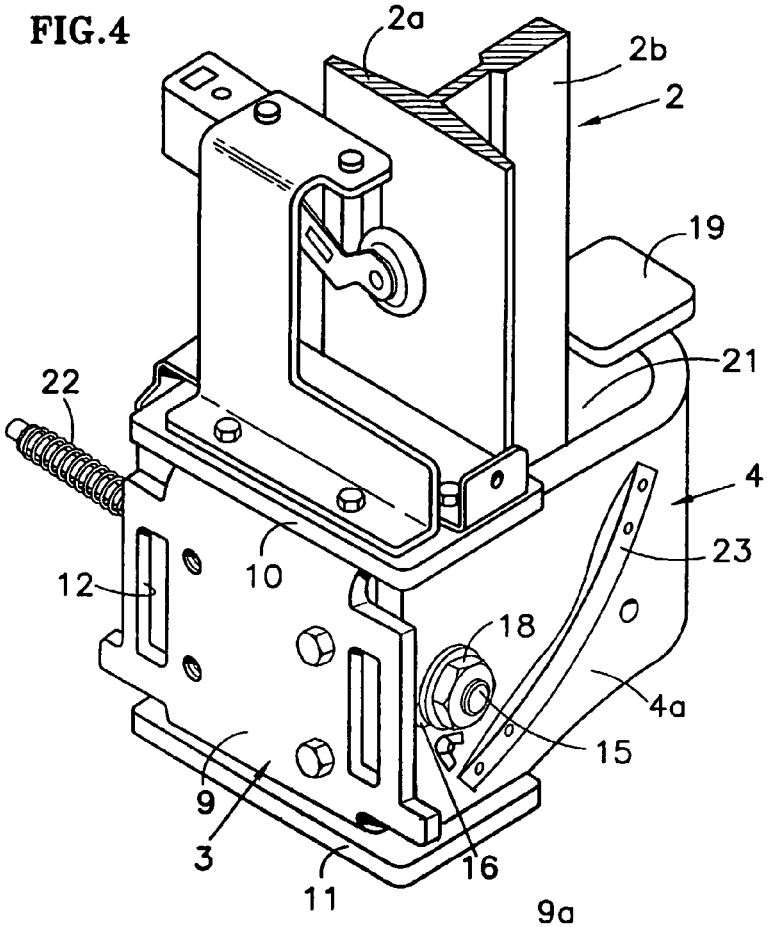
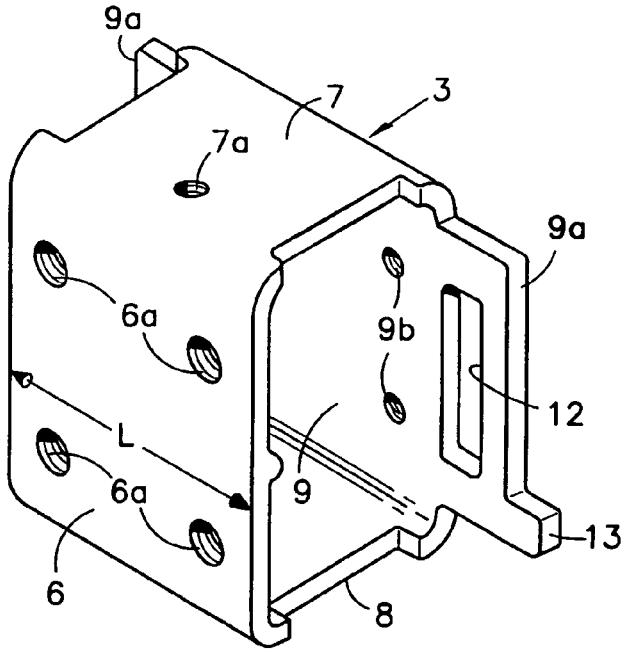
FIG.5

CAR FALL-PREVENTION APPARATUS

TECHNICAL FIELD OF THE INVENTION

This invention relates to an elevator car fall-prevention apparatus that is used when the car serves as a working base during elevator installation operations or during maintenance operations.

BACKGROUND OF THE INVENTION

It is known to provide a car fall-prevention device with a plate that contacts the back surface of a guide rail installed upright in the elevator shaft, and that is fastened to the guide rail. A support member is provided to the plate that supports the bottom part of the car, which is guided along the guide rail by guide rollers.

A projecting part that projects from the back surface of said guide rail in the direction of separation is integrally formed on said plate, and a hinge part that supports said support member so that it can rotate is also attached to said projecting part.

Said support member is able to rotate about said hinge part into a first position to avoid said guide rollers and a second position to support the bottom part of said car.

During elevator installation operations or the like, the mechanic rotates the support member to the second rotational position using a round rod as the operating member. The car is then lowered to be supported by the top surface of the support member so that the car can be used as a working base.

When the installation operation or the like is completed, said support member will be rotated to said first position, using said operating member while the car is raised and held in the standby position.

Such a system is well known and described in Japanese Patent No. 3209931, issued Jul. 13, 2001 to the Hitachi Building Systems Company, Ltd.

DISCLOSURE OF THE INVENTION

One problem, however, with the conventional passenger car fall-prevention apparatus described above, is when the support member is moved into the first standby position, it is simply positioned apart from the projecting part, which is no more than a free state away from the plate. For this reason, there is a risk that the support member will accidentally rotate into the second position due to vibrations that occur in the guide rail when the car is moving up and down.

As for the support member in the second position, the base is simply supported by the bottom of the projecting part, so there is a risk that there will be insufficient support strength for the car and reliable support will not be achieved.

The apparatus according to the present invention was devised taking into consideration the problems with said conventional car fall-prevention apparatus. According to a first embodiment of the present invention, said holding member is provided with a front wall that is attached at least to the back surface of said guide rail and a back wall that is arranged opposite said front wall. A locking hole is formed in the end of said back wall that runs in the length direction of the guide rail, and stop plates are attached to the top and bottom of said holding member. Said support member has a base formed to be able to lock and be held between the projecting ends of said top and bottom stop plates, and has a projecting part that can lock in said locking hole formed on the back edge of said base. A spindle, one end of which rotatably supports said support member from above and below through a slot formed in the base of said support member, is attached to said holding member such that it can slide axially, and a spring member that pulls said support member toward said holding member is also provided.

Then, it is characterized in that from the standby position, with said support member located by said guide rail's back side and being pulled toward said holding member by the spring force of said spring member, said support member is rotated forward while being pulled away from the side of said holding member against the spring force of the spring member, the forward end of the support member is positioned in front of the guide rail and, while the base of the support member is held gripped by said top and bottom stop plates, said projecting part is locked and held in said locking hole.

Thus, when no elevator installation operations or maintenance operations are to be performed, the spring force of the spring member forces the base of said support member against the holding member at the back side of the guide rail.

Therefore, the support member will be reliably held behind the guide rail when not in use, and will not rotate accidentally toward the front of the guide rail.

During elevator maintenance operations or the like, the support member is pulled in a direction to separate it from the holding member against the spring force of the spring member, and the forward end is rotated forward around the spindle while in the most pulled-out position. Then, when said forward end is rotated to a prescribed rotational position and the base part is positioned between the end parts of the top and bottom stop plates, said base is automatically locked between said end parts by being pulled toward the holding member by the spring force of the spring member. After this, when the support member is pulled toward the back via the spindle extending through the slot, with said base still captive, the projecting part of the base locks into the locking hole.

For this reason, the base of the support member is supported by being gripped by the two stop plates, and the projecting part is also supported by the edges of the locking hole. After this, when the car descends and is placed on the top surface of the forward end of the support member, the support rigidity will be great, and said car can be supported reliably and securely.

Also according to the present invention, the forward end of said support part is bent approximately into an L shape, and a capture part, that captures the forward part of said guide rail when the support member is retracted along said slot after said support member has been rotated toward the front from the back side of the guide rail around said spindle so that the forward end is positioned in front of the guide rail, is also provided on the inner surface of said forward end.

Still further according to the present invention, a handle for operating said support member is provided on the outside surface of the base of said support member.

And still further according to the present invention, a support base that supports the bottom surface of the car is provided on the side edge of the forward end of said support member, and a reinforcing part that reinforces said support base is provided on the outside surface of the forward end.

As is clear from the above explanation, when elevator installation operations or maintenance operations are not being performed, said support part can be reliably held at the back side of the guide rail, and the support member will not accidentally rotate toward the front of the guide rail.

Also, during elevator maintenance operations or the like, the support member is locked and held, forcibly gripped between the ends of the top and bottom stop plates by the spring member, and the projecting part on the base is locked in the locking hole. The rigidity of the support member for the car will be great, and said car can be supported reliably and securely.

According to the second embodiment of the present invention, when in use, the capture part of the support member captures the forward end of the guide rail, so that both the base end and the forward end of the support member are joined to the guide rail. Thus the support rigidity of the support member is further improved, the car can be supported more reliably, and the stability will be higher.

With the third embodiment of the present invention, the operation of pulling support member out against the spring force or of rotating it can be easily performed using the handle.

And according to the fourth embodiment of the present invention, the car can be supported more reliably by the support base and reinforcing part.

Figure 1:
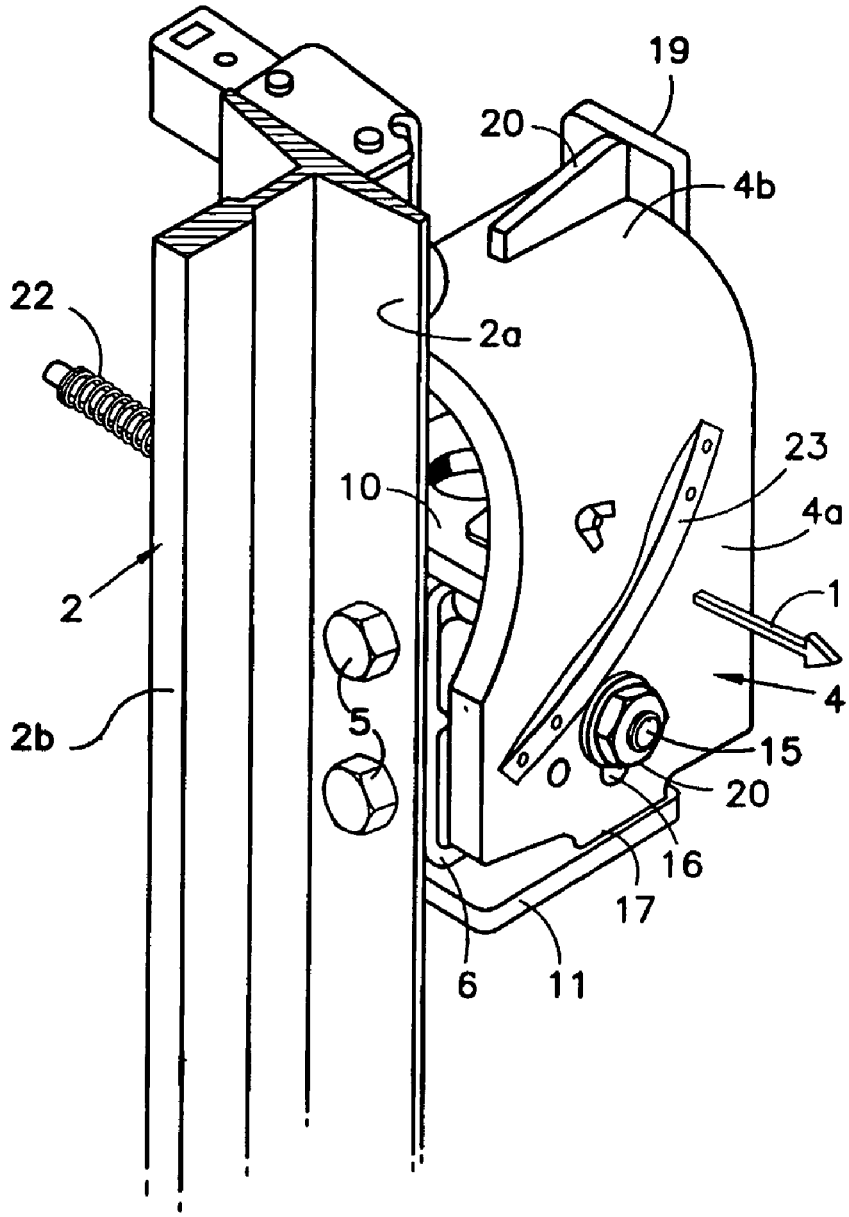
FIG. 1

An oblique front view of a car fall-prevention apparatus according to one embodiment of this invention, when it is not in use.

FIG. 2

An oblique rear view when the same car fall-prevention apparatus is not in use.

FIG. 3

An front oblique view when the same car fall-prevention apparatus is in use.

FIG. 4

An oblique rear view when the same car fall-prevention apparatus is in use.

FIG. 5

An front oblique view that shows the holding member provided for this embodiment.

FIG. 6

An oblique rear view that shows the holding member provided for this embodiment.

FIG. 7

An oblique view that shows the top and bottom stop plates attached to the holding member.

FIG. 8

An oblique view of the support member provided for this embodiment.

FIG. 9

An oblique view of the same support member.

FIG. 10

A plan view that illustrates the operation of this embodiment.

FIG. 11

A plan view that illustrates the operation of this embodiment.

PREFERRED EMBODIMENT OF THE INVENTION

One embodiment of a car fall-prevention apparatus according to this invention will be discussed in detail below with reference to the figures.

Specifically, this car fall-prevention apparatus, as shown in FIGS. 1-4, is provided with a pair of guide rails 2, one of which is shown in the drawings, that are installed vertically in elevator shaft not shown and that guide the car, not shown, up and down, a holding member 3 that is attached to the back surface of said guide rails 2, and a long plate-like support member 4 that is attached to said support member 3 to support the bottom part of said car.

Said guide rails 2 are of standard construction. They are constituted with base part 2*a*, in the form of a flat, long plate attached to a beam member, not shown, that is attached inside elevator shaft 1, and a rail part 2*b* that is integrally provided approximately in the center, axially, on the front surface of said base part 2*a*, and that guides the car up and down with guide rollers attached to the car.

Figure 6:
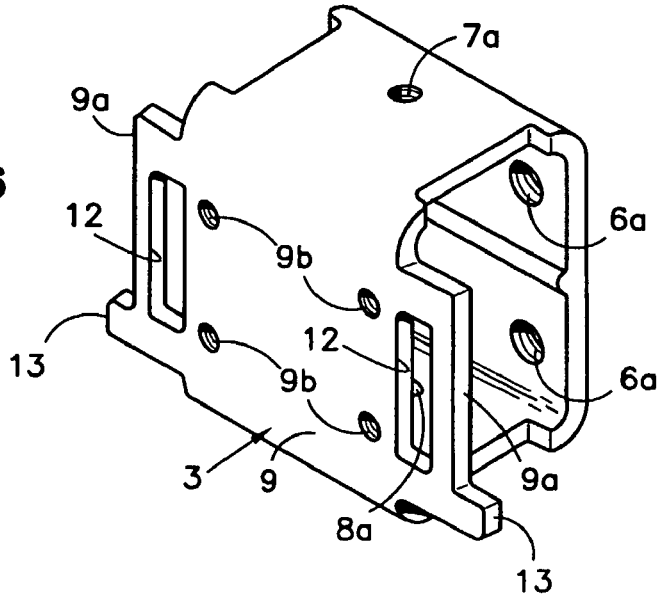
Figure 7:
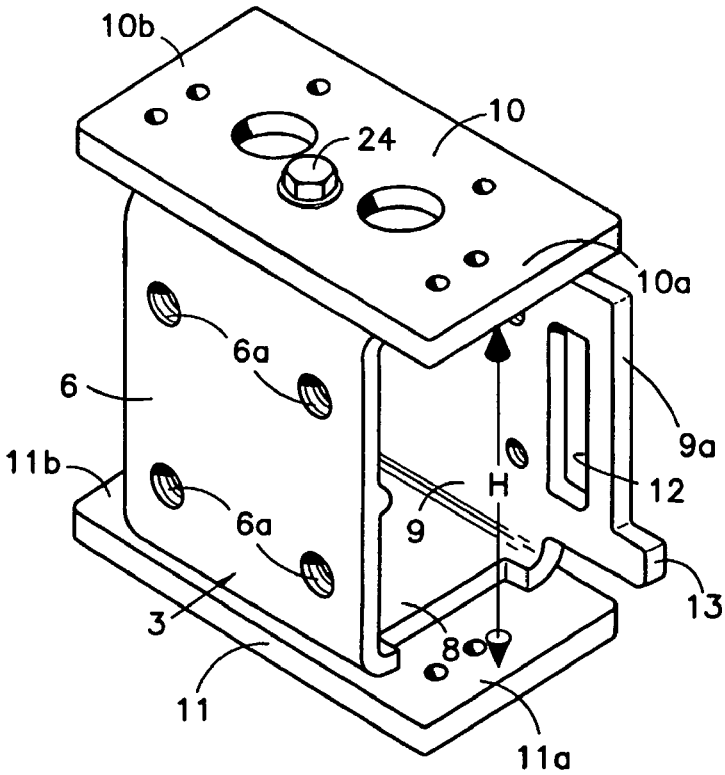

As shown in FIGS. 5-7, said holding member 3, is formed approximately in the form of a rectangular tube. It is constituted with front wall 6 attached to the back surface of base part 2*a* of said guide rail 2 by four bolts 5, top wall 7 and bottom wall 8, their edges on one side being integrally joined to the top and bottom edges of front wall 6, and back wall 9, opposite to front wall 6, which is joined to the edges on the other side of said top and bottom walls 7 and 8.

The length (L) of said front wall 6 is approximately the same dimension as the width of base part 2*a* of guide rail 2, and threaded holes 6*a* into which said bolts 5 are screwed are formed in the four corners.

The length of said top and bottom walls 7 and 8 is slightly shorter than the length of the front wall 6, and threaded holes 7*a* and 8*a* are formed in prescribed positions. Also, stop plates 10 and 11 are attached by bolts 24, respectively, screwed into said threaded holes 7*a* and 8*a* in the top and bottom surfaces.

Said back wall 9 is integrally provided with extension parts 9*a* and 9*a* that are longer at both ends than the width of base part 2*a* of guide rail 2. Long, thin rectangular locking holes 12 and 12 are also formed, extending vertically in each of said extension parts 9*a* and 9*a*. Threaded holes 9*b* and 9*b* are also formed near extension parts 9*a* and 9*a* on both ends, and projections 13 and 13 are integrally provided on the outside at the bottom of each of the extension parts 9*a* and 9*a*.

The length of said stop plates 10 and 11, as shown in FIG. 7, is greater than the length (L) of front wall 6 (the width of base part 2*a* of guide rail 2) and is approximately the same dimension as the length of said extension parts 9*a* and 9*a*. Also, the gap height (H) between end parts 10*a*, 10*b*, and 11*a*, 11*b* on both sides is slightly greater than the width of said support member 4.

Figure 10:
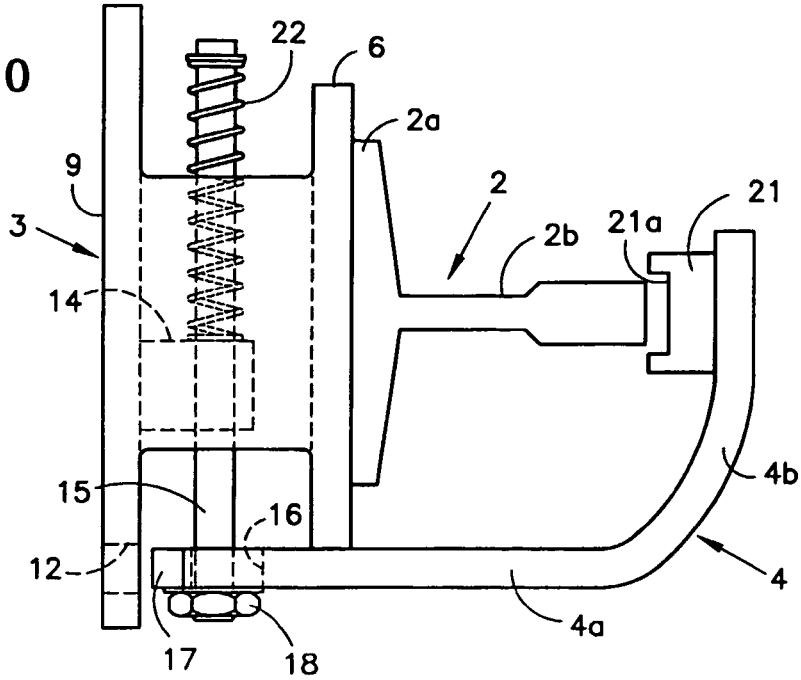
Figure 11:
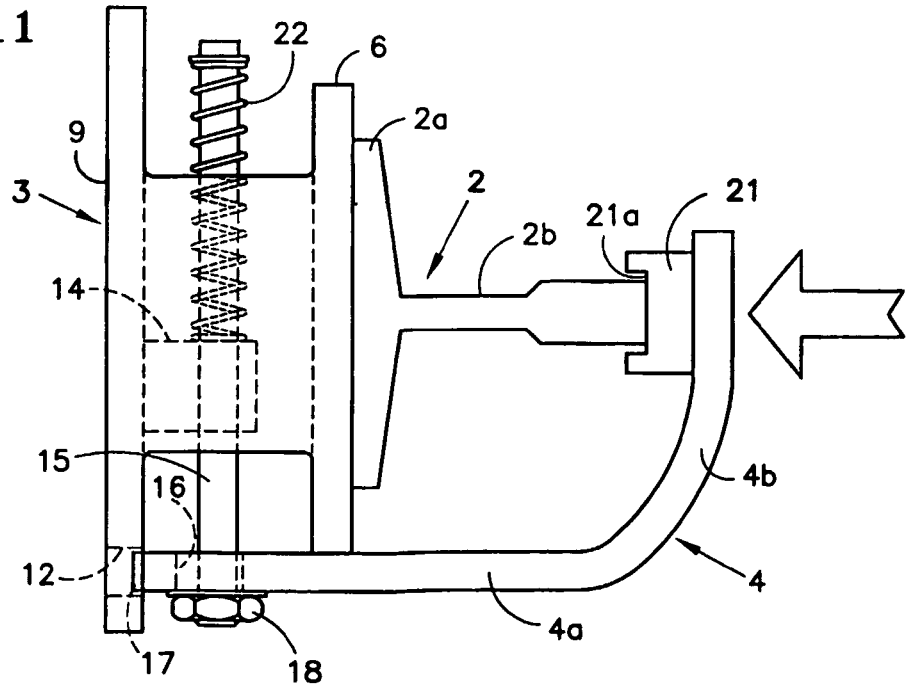

As shown in FIGS. 10 and 11, bracket 14 is bolted to the inside of said holding member 3 by means of said threaded holes 9*b* and 9*b*, and a spindle 15 that passes through the interior of holding member 3 is also supported by said bracket 14 such that is can slide axially.

Figure 8:
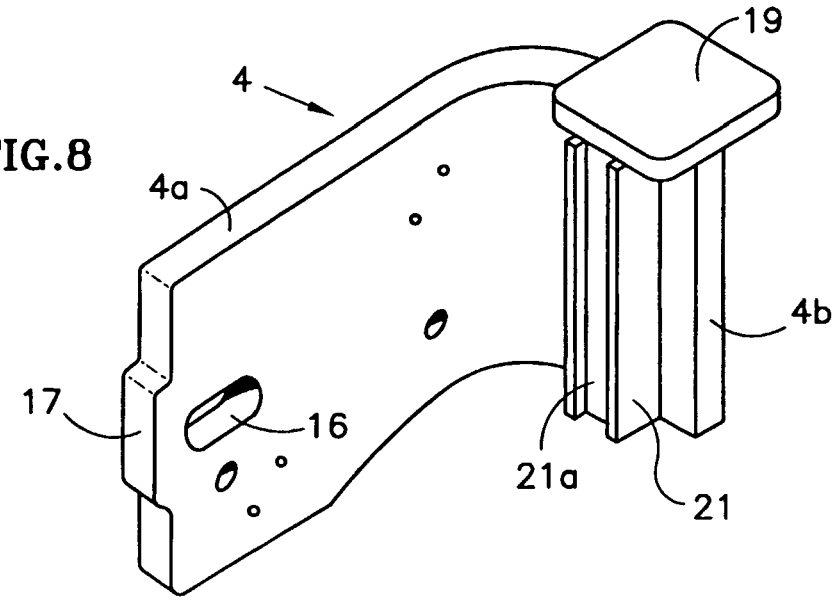
Figure 9:
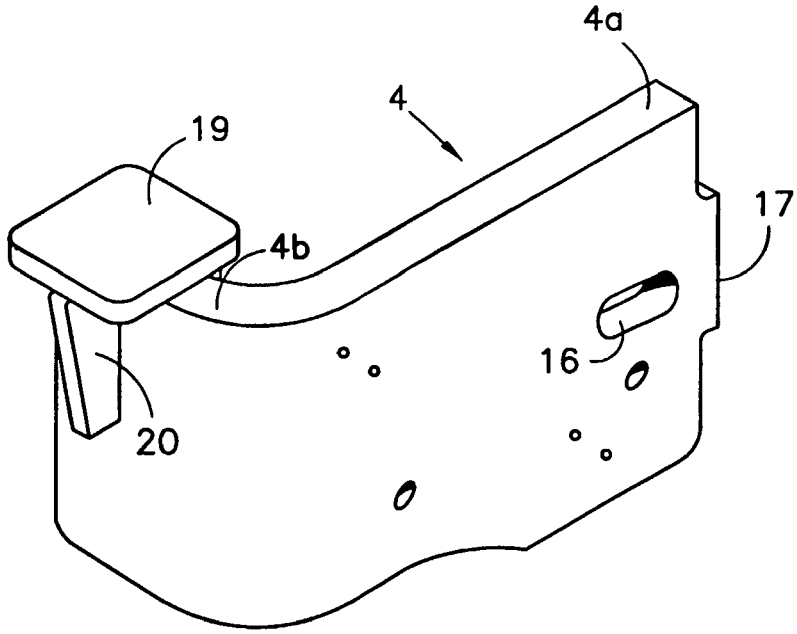

Said support member 4, as shown in FIGS. 8 and 9, is formed of metal in approximately a long plate shape. It is provided with base 4*a* that is suitably gripped between respective end parts 10*a* and 11*a* of top and bottom stop plates 10 and 11 and with forward end 4*b* that is integral with said base 4*a* at its front end and is bent approximately into an L shape.

Said base 4*a* has a slot 16 approximately in the center, measured axially, through which said spindle 15 passes. Also, a long, thin projecting part 17, which locks into said locking hole 12 when support member 4 is in use, is integrally provided at the outer end. Said support member 4 is pivotably supported overall on spindle 15, which is inserted through said slot 16 and has nut 18 threaded onto its outer end.

A support base 19, approximately in the form of a rectangular plate, that supports the bottom surface of the car is attached to one side edge (top side edge) of said forward end 4*b*, and a reinforcing part 20, approximately triangular, that supports the bottom surface of support base 19 is attached to the outer surface. A capture part 21 that captures the front of rail part 2*b* of said guide rail 2 when support member 4 is in use is also attached to the inner surface, on the side opposite from said reinforcing part 20. The capture part 21 is arranged vertically on the inner surface of forward end 4*b*, and a capture groove 21*a* that captures rail part 2*b* of guide rail 2 is formed in the shape of a long channel.

As shown in FIGS. 1 and 2, support member 4 is also pulled against the side part of holding member 3 by the spring force of a coil spring 22, which is a spring member fitted around the outside of said spindle 15. A handle 23 for operating said support member 4, such as for rotating it, is also attached to the outside surface of base 4*a*.

The operation of the car fall-prevention apparatus with said constitution is explained below.

First, as shown in FIGS. 1 and 2, when no elevator installation operations or maintenance operations are to be performed, the base 4*a* of said support member 4 is forcibly pulled up against the side of holding member 3 by the spring force of coil spring 22, and is positioned beside the back surface of base 2*a* of guide rail 2.

In other words, the base 4*a* side of support member 4 is pulled against the side of support member 3 in the axial direction of spindle 15, while at the same time the forward end 4*b* contacts it and is held from the holding member 3 side to the top of top stop plate 10 by virtue of its bent shape.

Therefore, support member 4, when not in use, will be reliably beside the back surface of base part 2*a* of guide rail 2, held by the spring force of coil spring 22 so it will not accidentally rotate toward the front of guide rail 2.

On the other hand, when elevator maintenance operations are to be performed, the mechanic will pull support member 4 from the position shown in FIG. 1, in the direction of the arrow 1 in FIG. 1 while grasping handle 23. That is, it is pulled in a direction to separate it from holding member 3, along spindle 15 against the spring force of coil spring 22, and forward end 4*b* is rotated from the upward position to the forward position around spindle 15 when it has been pulled out to its furthest extent.

Then when said forward end 4*b* has been rotated to a prescribed rotational position and base 4*a* is positioned between the end parts 10*a* and 11*a* of the top and bottom stop plates 10 and 11, base 4*a* is automatically locked between said end parts 10*a* and 11*a* when it is pulled toward holding member 3 by the spring force of coil spring 22, as shown in FIGS. 3 and 4.

After this, as shown in FIGS. 10 and 11, when support member 3 is pushed toward the back along slot 16 via spindle 15, with said base 4*a* remaining captive, projecting part 17 of base 4*a* locks into locking hole 12 of extension part 9*a*, and capture groove 19*a* of capture part 21*a* of capture part 21 also captures the forward end of rail part 2*b* of guide rail 2.

Because of this, base 4*a* of support member 4 is supported by being gripped by the two stop plates 10 and 11, while the back end of base 4*a* is supported by the edge of locking hole 12 via projecting part 17. This provides great support rigidity for the car that then descends and rests on the top surface of support base 19 of forward end 4*b* of support member 4, and said car can be supported reliably and securely.

In particular, the support rigidity of support member 4 is improved by the capture of guide rail 2 by capture part 21, allowing the car to be supported more reliably, and producing a high degree of safety.

The operations of pulling support member 4 out against the spring force of coil spring 22 and of rotating it are also made easy by handle 23.

In addition, the car can be more reliably supported by support base 19 together with reinforcing part 20.

This invention is not limited to the constitution of this embodiment. For example, it is possible to arrange support member 4 on the opposite side of support holding member 3. In this case, spindle 15, etc., can be attached in the opposite direction and the entire layout can be freely adapted.

We claim:

1. A car fall-prevention apparatus comprising:

a guide rail installed vertically in an elevator shaft to guide a car up and down, a nearly tubular holding member that is attached to a back surface of said guide rail, said holding member comprising:

a front wall that is attached to the back surface of said guide rail and a back wall that is arranged opposite said front wall, a locking hole running in an axial direction of the guide rail, said locking hole being formed in an end of said back wall, a long plate-like support member attached to said holding member to support a bottom part of said car;

a spring member that pulls said support member toward said holding member; and top and bottom stop plates that are also attached above and below said holding member, wherein said support member includes a base formed to be able to lock and be held between projecting ends of said top and bottom stop plates, wherein a projecting part, which can lock into said locking hole, is formed in a back edge of said support member base, wherein a spindle, one end of which rotatably supports said support member from above and below via a slot formed in the base of said support member, is attached to said holding member such that it can slide axially, wherein from a standby position, with said support member located on said guide rail's back side and being pulled toward said holding member by a spring force of said spring member, said support member is adapted to be rotated forward while being pulled away from a side of said holding member against the spring force of the spring member, and wherein when a forward end of the support member is positioned in front of the guide rail, while the base of the support member is held gripped by said top and bottom stop plates, said projecting part will also lock and be held in said locking hole.

2. The car fall-prevention apparatus described in claim 1, wherein said forward end of said support member is formed approximately in an L shape, and wherein a capture part, which captures a forward part of said guide rail when the support member is retracted along said slot after said support member has been rotated toward the front from the back side of the guide rail around said spindle so that the forward end is positioned in front of the guide rail, is also provided on an inner surface of said forward end.

3. The car fall prevention device described in claim 1, wherein a handle for operating said support member is provided on an outside surface of the base of said support member.

4. The car fall-prevention apparatus described in claim 1, wherein a support base that supports a bottom surface of the car is provided on a side edge of the forward end of said support member, and wherein a reinforcing part, which reinforces said support base, is also provided on an outside surface of said forward end.

* * * * *